US005794914A

United States Patent [19]

Woodward

[11] Patent Number: 5,794,914

[45] Date of Patent: Aug. 18, 1998

[54] WEDGE SECURING DEVICE

[75] Inventor: Jonathan R. Woodward, Salt Lake City, Utah

[73] Assignee: Black Diamond Equipment Ltd., Salt Lake City, Utah

[21] Appl. No.: 880,115

[22] Filed: Jun. 20, 1997

Related U.S. Application Data

[63] Continuation of Ser. No. 515,094, Aug. 14, 1995, abandoned.

[51] Int. Cl.[6] ..... F16M 13/00

[52] U.S. Cl. ..... 248/925; 248/317

[58] Field of Search ..... 248/925, 695, 248/231.9, 328, 317; 52/711, 705, 704

[56] References Cited

U.S. PATENT DOCUMENTS

| | | | |
|---|---|---|---|
| 2,395,749 | 2/1946 | Miller | 248/317 |
| 3,957,237 | 5/1976 | Campbell | 248/317 X |
| 4,082,241 | 4/1978 | Burkey | 248/925 X |

FOREIGN PATENT DOCUMENTS

| | | | |
|---|---|---|---|
| 2553668 | 4/1985 | France | 248/925 |
| 3126346 | 1/1983 | Germany | 248/925 |
| 3526402 | 2/1987 | Germany | 248/925 |

OTHER PUBLICATIONS

Sheet showing wedging protection and "Copperhead".

*Primary Examiner*—Ramon O. Ramirez
*Assistant Examiner*—Willie Berry, Jr.
*Attorney, Agent, or Firm*—Thorpe, North & Western LLP

[57] ABSTRACT

A wedge securing device, which includes a body having a void into which the ends of a cable are placed, the cable being affixed to the body by compressing body thereby closing the void upon the cable and securing the cable to the body. The cable being thus attached to the body, forms a loop to which carbineer and other devices may be connected.

14 Claims, 2 Drawing Sheets

WEDGE SECURING DEVICE

This application is a continuation of application Ser. No. 08/515,094 filed Aug. 14, 1995 now abandoned Jun. 20, 1997.

BACKGROUND OF THE INVENTION

1. The Field of the Invention

The invention herein pertains to the field of wedges, more particularly to wedge climbing protection.

2. The Background Art

A wedge, often referred to as wedging protection, is a basic tool in the equipment of a climber. Wedges are used with carbineers, ropes and other protection in a variety of configurations. Typically, a number of wedges of differing sizes and proven wedge shapes are carried by a climber. The wedges are placed into the climbing surface when a climber is ascending the surface. The body of a wedge is placed into cracks, crags, small crevices, and other positions where it may be wedged between two surfaces. A carbineer or other protective device is then attached to the connective means of the wedge and the climber's rope is passed through the carbineer or protective device. The wedge is often later retrieved and reused.

It is desirable that the wedges be as light as possible, to lighten the load of the climber, while also being as strong as possible to support the weight and forces to which they may be subjected when, for example, supporting the climber; the body of the wedge and the connecting means should not separate, nor should the body of the wedge substantially deform, when the wedge is supporting the climber. Additionally, it is desirable that wedges and other protective gear be designed for ease of use.

A problem in the art of wedges is how to attach the wedge body to the connecting means of the wedge. One common method in the art has been to attach a cable to the body of the wedge by placing a hole or holes through the body, passing the cable through the hole or holes, and then closing the loop of the cable by clamping the ends of the cable together with an additional component, known as a swage. With this method, the body of the wedge can slide, more or less, with respect to the cable. The disadvantages of this method arise from the additional component (swage) which introduces additional weight and bulk.

As the sliding of the body of the wedge with respect to the cable is not always a desired quality, two other wedges have been developed in the art. One uses solder to affix the ends of a cable to the body of the wedge and another, known as a "copperhead", uses two similarly sized and shaped cylindrical swages. One cylindrical swage is used to connect one end of the cable to a central portion of the cable, forming a small loop with a single strand of cable extending out from the swage to a second cylindrical swage, which is attached to the second end of cable.

The method using solder not only has increased weight, but depends upon the quality and material properties for the quality of the security of the attachment of the cable to the wedge. Also, the heat resulting from soldering weakens and embrittles the cable at its points of attachment to the wedge.

The "copperhead", having the added mass of two cylindrical swages attached to the cable, has only solved for the sliding concern. The "copperhead" does not address the concern with weight and there is no wedge or wedge-shaped element for secure placement in a crack, crevice, etc.

OBJECTS AND SUMMARY OF THE INVENTION

It is therefore an object of the present invention to provide a wedge securing device that is both strong, easy to use, and easy to carry.

It is another object of the invention, in accordance with one aspect thereof, to provide a wedge securing device that is of minimal mass.

It is another object of the invention, in accordance with one aspect thereof, to provide a wedge securing device where the wedge body is of a proven shape and will not substantially deform.

The above objects and others not specifically recited are realized in a specific illustrative embodiment of a wedge securing device, which includes a wedge-shaped body having a void or voids into which the ends of a cable are placed, the cable being affixed to the wedge body by having an applied force to the wedge body, thereby closing the void or voids upon the cable (swaging) and securing the cable in the wedge body. The cable being thus attached to the wedge body, forms a loop to which carbineer and other devices may be connected. Thus, the only component attached to the cable is the wedge body, which does not slide on the cable. The wedge securing device is thus of minimal mass.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
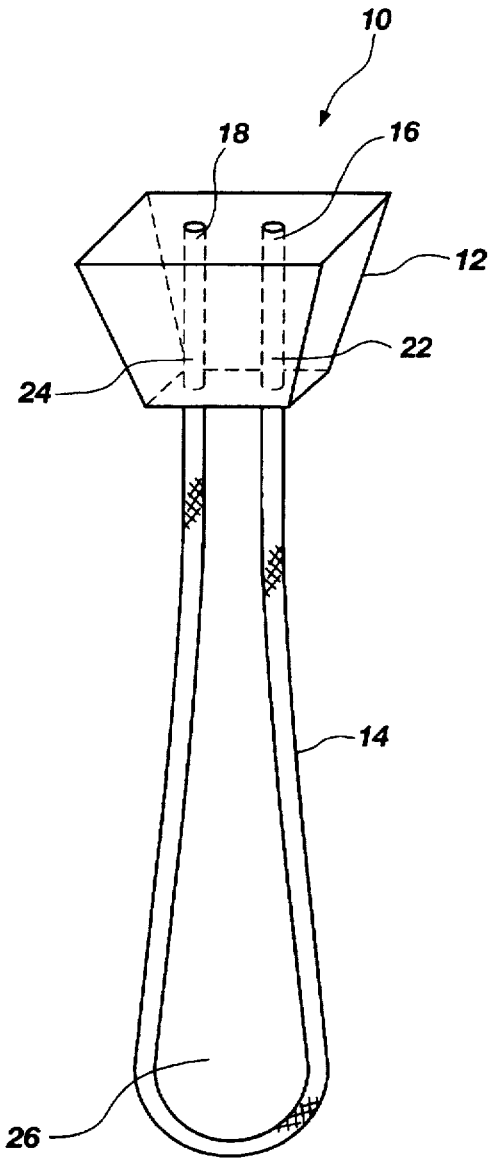
FIG. 1 is a perspective view of a wedge securing device made in accordance with the principles of the present invention.

Referring to FIG. 1, there is shown a preferred embodiment of the wedge securing device (hereinafter referred to simply as "wedge"), generally designated at 10. The wedge 10 has a wedging body 12 made for example of a deformable material such as copper-steel alloy, brass, steel, and aluminum or titanium and alloys thereof, and a flexible cable 14. The wedging body 12 has two voids, shown in FIG. 1 as first 16 and second 18 bores. The flexible cable 14 has a first end 22 and a second end 24.

The first and second ends 22, 24 of the cable 14 extend at least into, if not through, the first and second bores 16, 18, respectively, of the wedging body 12.

The bores 16, 18 are closed upon the ends 22, 24 of the cable 14, thus attaching the cable 14 to the wedging body 12 and forming a connecting loop 26. The bores are closed by applying force to the wedging body 12, either by compressing the wedging body 12 or striking the wedging body, thereby causing the bores 16, 18 to tighten upon the ends 22, 24 of the cable 14.

Figure 2:
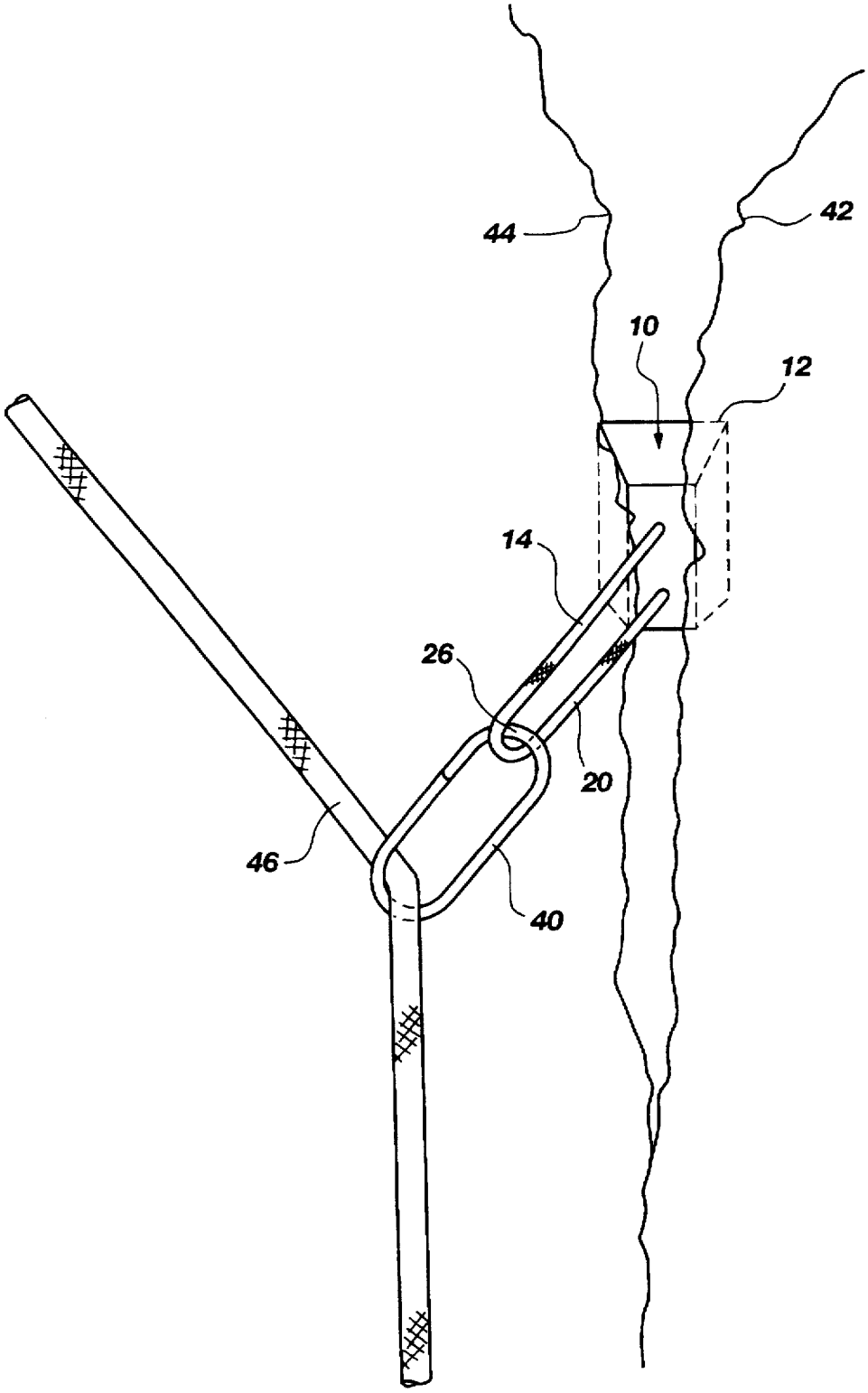
FIG. 2 is a perspective view of the wedge securing device of FIG. 1, shown placed between two surfaces and showing its use with a carbineer and a rope.

The preferred embodiment of the wedge 10 has a polyhedron shaped wedging body 12, shown in FIG. 1 as a hexahedron (but not necessarily with planar sides). As shown in FIG. 2, the wedging body 12 is placed between two surfaces 42, 44 with the cable 14 extending out so that other objects, such as carbineer 40, may be attached. A rope 46, or other piece of equipment, may then be attached to the carbineer, and will be held in position by the wedge 10. The wedging body 12 anchors the wedge 10 between the surfaces 42, 44, while the flexible cable 14 allows for some movement of the objects attached thereto.

Figure 3:
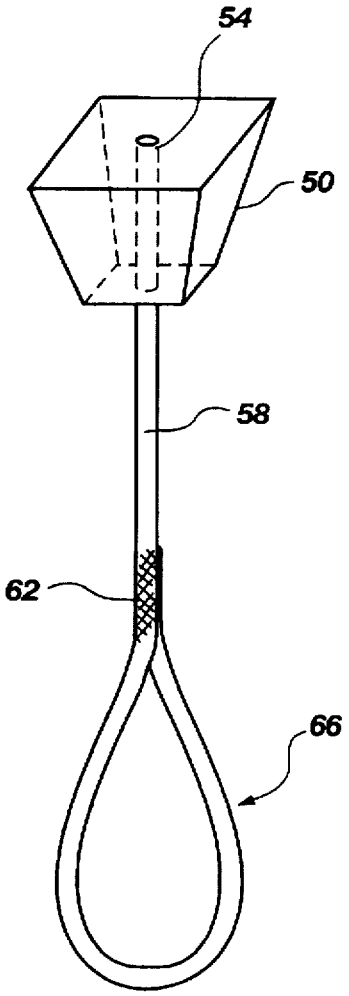
FIG. 3 is a perspective view of another embodiment of a wedge securing device made in accordance with the present invention.

FIG. 3 shows an alternative embodiment of the present invention to include a wedge body 50 shaped similarly to that of FIG. 1, and a bore 54 extending through the body for receiving one end of a cable 58. The other end of the cable 58 is looped back on itself and weaved (if the cable is constructed of a multiplicity of fibers) in with a middle section 62, or otherwise attached to the middle section, to form a loop 66, as shown. This configuration provides the necessary wedging element for insertion in a crack or crevice, and a connecting element in the form of a loop 66 for attaching to a carbineer or other climbing implements.

While the preferred embodiments are shown extending through the wedging bodies, the bores may only extend partially into the wedging bodies. The bores may be formed in the wedging body when the wedging body is manufactured, or after its manufacture. The wedging body may be manufactured in any of those methods known to those skilled in the practice of the art, including die casting, cold working, or milling. The final shape of the wedging body can be accomplished at any time before, during or after attaching the flexible cable; and the wedging body may have one or more faces which are inclined.

As will be appreciated, the wedge shape of the body may be formed before, during or after the end of the flexible loop is attached. Thus, the wedge-shaped body may be compressed attaching the flexible loop, or the body may be formed into a wedge while compressing the body to attach the flexible cable, or the body may be shaped after it is compressed when attaching the cable.

Further, the flexible loop may be formed by weaving the cable together, to form a flexible loop having one end attached to the wedge body and one end formed into a loop (as shown in FIG. 3). Alternatively, the cable may have two ends which are placed into the void or voids of the body of the wedge securing device and then attached; and in this manner form a loop (as shown in FIG. 1).

Additionally, the practice of the invention is not limited to use of cable, or only one cable. The flexible cable may be practiced with any kind of flexible wire, composite material, fabric cord, strand or device which may be attached to the wedging body as taught by the invention. Furthermore, the flexible cable may be made of any material, including: metals, plastics, or fibers.

Those skilled in the art will appreciate from the preceding disclosure that the objectives stated above are advantageously achieved by the present invention. While the present invention is described in terms of wedge, it is to be understood that the subject apparatus and method may be used in any field of wedging application. Those having ordinary skill in the field of this invention will appreciate the advantages of the invention, and its application to a wide variety of platform vehicle uses.

It is to be understood that the above-described arrangements are only illustrative of the application of the principles of the invention. Numerous modifications and alternative arrangements may be devised by those skilled in the art without departing from the spirit and scope of the present invention and the appended claims are intended to cover such modifications and arrangements.

What is claimed is:

1. A wedge securing device for mountain climbing, the device comprising:

a wedging body having at least six sides including four sides, a top side, and a bottom side, at least two opposing sides of the at least six sides being inclined toward one another in a wedge-shaped fashion, the wedging body for wedging between at least two surfaces;

at least two voids formed in the wedging body including a first void and a second void, the at least two voids having interior sidewalls defining the at least two voids;

at least one flexible cable having a first end secured in the first void and a second end secured in the second void, the flexible cable forming a connection means extending from the wedging body for attaching an object thereto; and the interior sidewalls of the first void and the second void being closed upon the first end and the second end of the flexible cable respectively, thereby clamping and attaching the flexible cable to the wedging body.

2. The device as in claim 1, wherein said interior sidewalls are closed upon said first and second ends of said flexible cable by applying force to said wedging body.

3. The device as in claim 2, wherein said force applied to said wedging body is a compressive force.

4. The device as in claim 2, wherein said force applied to said wedging body is striking force.

5. The device as in claim 1, wherein said wedging body comprises a body that is sufficiently malleable so as to be compressible upon said flexible cable to prevent separation of the cable from the body.

6. The device as in claim 1, wherein the first void and the second void comprise a first bore and a second bore formed in said wedging body, and wherein the first end of the cable is secured in the first bore, and the second end of the cable is secured in the second bore, both by swaging of the wedging body.

7. A method for making a wedge securing device for mountain climbing and the like, comprising the steps of:

(a) forming a wedging body for wedging between at least two surfaces, the wedging body having at least two voids including a first void and a second void, the at least two voids having interior sidewalls defining the at least two voids;

(b) selecting at least one flexible cable having a first end and a second end;

(c) inserting the first end of the cable into the first void;

(d) inserting the second end of the cable into the second void thereby forming a loop with the flexible cable, for connecting objects thereto; and (e) closing the interior sidewalls upon the first end and the second end of the cable to secure the cable to the wedging body.

8. The device as in claim 7, further comprising:

closing said interior sidewalls by compressing said wedging body.

9. The device as in claim 7, further comprising:

closing said interior sidewalls void by striking said wedging body.

10. The device as in claim 7, further comprising:

selecting a wedging body which is sufficiently malleable to close upon said flexible cable to prevent the separation of said flexible cable from said wedging body.

11. A method for making a wedge securing device for mountain climbing and the like, comprising the steps of:

(a) forming a body having at least two voids including a first void and a second void, the at least two voids having interior sidewalls defining the at least two voids;

(b) selecting at least one flexible cable having a first end and a second end;

(c) inserting the first end of the cable into the first void;

(d) inserting the second end of the cable into the second void thereby forming a loop with the flexible cable, for connecting objects thereto;

(e) closing the interior sidewalls upon the first end and the second end of the cable, to secure the cable to the body; and (f) forming the body into a wedge.

12. The device as in claim 11, further comprising:

closing said interior sidewalls by compressing said body.

13. The device as in claim 11, further comprising:

closing said interior sidewalls by striking said body.

14. The device as in claim 11, further comprising:

selecting a body which is sufficiently malleable to close upon said flexible cable to prevent the separation of said flexible cable from said wedging body.

* * * * *